US006955134B2

(12) United States Patent
Prins

(10) Patent No.: US 6,955,134 B2
(45) Date of Patent: Oct. 18, 2005

(54) VESSEL, PROVIDED WITH A GANG PLANK FOR COUPLING TO AN OFFSHORE POLE STRUCTURE

(75) Inventor: Reinout Klaar Norfolc Jaap Prins, Ijmuiden (NL)

(73) Assignee: P&R Systems, Ijmuiden (NL)

( * ) Notice: Subject to any disclaimer, the term of this patent is extended or adjusted under 35 U.S.C. 154(b) by 179 days.

(21) Appl. No.: 10/363,288

(22) PCT Filed: Sep. 5, 2001

(86) PCT No.: PCT/NL01/00659

§ 371 (c)(1),
(2), (4) Date: Feb. 27, 2003

(87) PCT Pub. No.: WO02/20343

PCT Pub. Date: Mar. 14, 2002

(65) Prior Publication Data

US 2003/0182741 A1 Oct. 2, 2003

(30) Foreign Application Priority Data

Sep. 6, 2000 (NL) ..... 101611

(51) Int. Cl.[7] ..... B63B 21/08

(52) U.S. Cl. ..... 114/230.17; 114/230.14; 14/69.5

(58) Field of Search ..... 14/69.5, 71.1; 114/230.14, 230.17, 258, 230

(56) References Cited

U.S. PATENT DOCUMENTS

| | | | | |
|---|---|---|---|---|
| 4,003,473 A | | 1/1977 | Ryan | |
| 4,133,283 A | * | 1/1979 | Ryan | 114/230.18 |
| 4,157,742 A | * | 6/1979 | Aanensen | 182/97 |
| 4,162,551 A | * | 7/1979 | Serrano | 14/69.5 |
| 4,366,591 A | * | 1/1983 | Zimmerman | 14/71.3 |
| 4,421,051 A | * | 12/1983 | Hammett | 114/264 |
| 4,459,930 A | * | 7/1984 | Flory | 114/230.14 |
| 4,590,634 A | * | 5/1986 | Williams | 14/71.1 |
| 5,044,829 A | * | 9/1991 | Hemminger | 405/203 |
| 6,347,424 B1 | * | 2/2002 | Vatne | 14/69.5 |
| 6,609,544 B1 | * | 8/2003 | Williamson | 141/387 |
| 6,721,985 B2 | * | 4/2004 | McCrary | 14/77.1 |

FOREIGN PATENT DOCUMENTS

| | | |
|---|---|---|
| DE | 1 784 940 | 5/1972 |
| FR | 2 465 640 | 3/1981 |
| GB | 2 175 860 | 12/1986 |
| GB | 2 336 828 | 11/1999 |
| WO | WO00/15489 | 3/2000 |

OTHER PUBLICATIONS

"OWEMES '97", European seminar Apr. 10–11, 1997 5 pages.*
"OPTI–OWECS Final Report", vol. 4; Aug. 1998 3 pgs.*
"OWEMES, 2000", Euopean Seminar; Apr. 13–15, 2000 4 pgs.*
"European Community Wind Energy conference" Sep. 10–14, 1990, 4 pgs.*
"OWEMES '97" European Seminar, Apr. 10–11, 1997, 4 pgs. Ref. 1.*

* cited by examiner

*Primary Examiner*—Thomas B. Will
*Assistant Examiner*—Raymond W Addie
(74) *Attorney, Agent, or Firm*—Hoffmann & Baron, LLP

(57) ABSTRACT

A vessel provided with a telescopingly extendable gang plank mounted thereon for movement about a vertical axis. A coupling device provided at the free end of the gang plank is adapted to enclose a vertically directed engagement rod on an offshore pole body and thus connect the ship to the pole body. With tile ship manoeuvred in a certain position the gang plank may be either directed and extended towards tile engagement rod or be manoeuvred while taking its extended position laterally into contact with the engagement rod and subsequently (partially) retracted again.

11 Claims, 3 Drawing Sheets

VESSEL, PROVIDED WITH A GANG PLANK FOR COUPLING TO AN OFFSHORE POLE STRUCTURE

CROSS-REFERENCE TO RELATED APPLICATIONS

This application is the national stage filing under 35 U.S.C.§371 of PCT/NLO1/00659, filed Sept. 5, 2001, which claims priority to NL 1016111, filed Sept. 6, 2000, both of which are incorporated herein by reference.

BACKGROUND OF THE INVENTION

The invention relates to a vessel as defined in the first part of claim 1.

Such a vessel is disclosed in French patent publication FR 2465640. With this well-known vessel that is adapted to transfer personnel to and from an offshore structure built on piles, the gang plank is designed to be provisionally connected to the offshore structure by means of a line that is to be "thrown out". Subsequently the line is "hauled in" to cause the gang plank to extend towards the connecting site. In this case the engagement rod is constituted by a curved rod which is positioned in a horizontal plane.

Throwing out a provisional connecting line is laboreous and also constitutes hazard for the personnel which has to be present at the end of the gang plank and to be coupled. Furthermore, with the well-known vessel, even moderate wave motion will cause the end of the gang plank to move up and down rather extensively, which up and down movements are difficult to be controlled by the inhauling line and thus make it very difficult to complete the connection to the horizontally oriented engagement rod.

SUMMARY OF THE INVENTION

The invention aims at providing a solution for the problem mentioned hereinabove.

According to the invention this aim is achieved through the features which are defined in the second part of claim 1.

Thus the vessel of the present invention is adapted to cooperate with, i.e. to be connected with its gang plank to an offshore pole body, that is provided with a substantially vertically directed engagement rod. In operation, as soon as the vessel of the present invention has reached a suitable starting position relative to the offshore pole body provided with a vertically directed engagement rod, the desired connection can be realized relatively simply. To this end, according to a practical procedure, the gang plank is turned and thereby directed to the central part of the engagement rod, upon which the gang plank is extended until the coupling device has enclosed the engagement rod. Up and down going movements of the free end of the gang plank, which may be caused by the vessel bobbing on the waves, will not or hardly affect the coupling procedure, as the vertically directed engagement rod will allow the coupling device to move along the engagement rod during coupling. In the horizontal plane the position of the coupling device can be simply adjusted through corrective turning movements.

By using a vertically directed engagement rod and a correspondingly adapted coupling device there is also an alternative way to realize the coupling. According to this alternative procedure the gang plank positioned at a certain inclination is extended beyond the engagement rod after which the extended gang plank is laterally turned into contact with the engagement rod and then retracted to allow the coupling device to engage the engagement rod.

It is to be remarked that International Patent Application WO 00/15489 discloses a vessel provided with a gang plank adapted to be coupled to an offshore pole body whereby—as with the vessel according to the above mentioned French patent publication—an engagement rod is positioned in a horizontal plane, but wherein no line needs to be thrown out for the coupling procedure. In this case a non-extendable gang plank is involved, which is pivotally connected to the vessel about a horizontal transversally directed axis only. This well-known gang plank is provided at its free end with a pair of guide wheels through which the gang plank is pushed—in operation—by the vessel against the pole body and along the pole body upwardly into the coupling position. With this well-known vessel the possibilities of manoeuvring are very limited, so that especially in case of heavy seas it is difficult to have the gang plank "approach" in the correct direction and—after the gang plank end having been brought into contact with the pole body—maintain such contact during the further procedure. Consequently, in this case there is no question of a uniform guidance of the gang plank end along the pole body as a condition for an effective coupling procedure.

Finally it is to be remarked that independently extendable gang planks are known per se, such as disclosed in U.S. Pat. No. 4,366,591, wherein an hydraulically retractable/extendable gang plank or ladder is mounted with one end on a pier or dock and is adapted to have its free end resting freely onto the deck of a ship that lies moored along the pier or dock.

BRIEF DESCRIPTION OF THE DRAWINGS

The invention will be hereinafter further explained by way of two examples with reference to the accompanying drawings, in which.

DETAILED DESCRIPTION OF THE INVENTION

Figure 1:
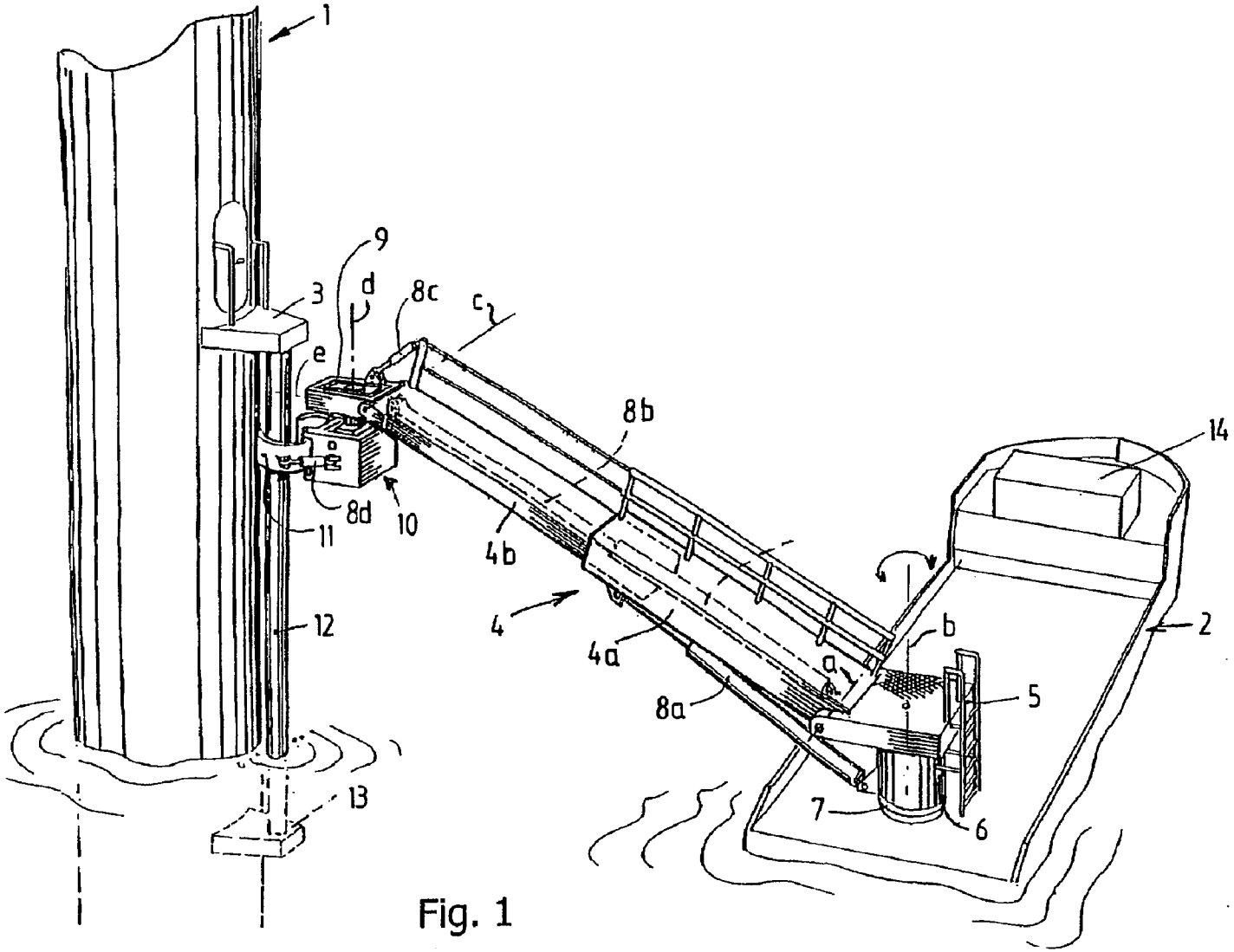
FIG. 1 is a perspective view of the vessel of the present invention, showing the completion of the coupling of the vessel to an offshore "monopole", with the gang plank being directed substantially radially relative to the pole body.

In FIG. 1 there is shown an offshore pole, also called monopole. In practice this may be e.g. a supporting column of a windmill or a supporting leg of an offshore platform.

2 is a vessel, e.g. of the "service vessel" type, that carries the personnel that has to climb the pole 1 to carry out maintenance or repair work therein. To facilitate the carrying out of these activities the pole 1, which for the rest is substantially plane, is provided with a platform 3 projecting therefrom at working level.

In order that the personnel may safely cross from the vessel 2 to the platform 3 on pole 1 and vice versa at any time between high and low tide the present invention provides in the use of a retractable and extendable gang plank 4. One section 4*a* of it is pivotally connected, about a horizontal axis a, to a cross-over platform 5 at the upper end of a column 6, which is mounted on the deck of the vessel through a turntable 7 for a rotary movement about a vertical axis b.

An hydraulic piston cylinder device 8*a* extends between the column 6 and a location on the lower side of the gang plank section 4*a* and may adjust the angle of inclination of the gang plank 4.

The second section 4*b* of the gang plank 4, which may be retracted or extended by means of an hydraulic piston cylinder device 8*a*, has its free end pivotally connected—about a transverse axis c—to a cross-over platform 9 that may be kept in the desired (=horizontal) position relative to the gang plank 4 by means of an hydraulic cylinder 8*c* supported on the gang plank section 4*b*.

A coupling device 10 is suspended to the cross-over platform 9. The suspension is such that there is a certain freedom of movement about the mutually perpendicularly directed axes d and c, which axes are each perpendicularly directed relative to the pivot axis e.

The coupling device 10 serves to establish a coupling to the pole 1 at a location adjacent the platform 3. For this purpose the coupling device 10 is provided with two coupling jaws 11 which may be turned towards another from an opened position (shown in the drawing). The coupling jaws 11 are actuated by hydraulic piston cylinder devices 8*d* (one of which is shown in the drawing) on either side of the housing of the coupling device 10.

The piston cylinder devices 8*d* are making part of an hydraulic circuit, which also comprises the hydraulic piston cylinder devices 8*a*, 8*b* and 8*c*, as well as the drive means (not shown) for the turntable 7.

The coupling jaws 11 are adapted to cooperate with a coupling part provided on the pole, which coupling part—in the example under consideration—is constituted by a guide and coupling rod 12 that is suspended from the platform 3 and has its lower end supported by a bracket 13 projecting from the pole 1.

The operation is as follows. In the no-use mode the gang plank 4 is positioned according to the longitudinal axis of the vessel 2, while the plank has its extendable plank section 4*b* supported on the support 14 provided at the front of the vessel. With the gang plank in this position the vessel may go out for the transfer of one or more mechanics to the platform 3 on the pole 1 for carrying out work, such as the removal of defects. Upon approaching near to the pole 1 the ship 2 is positioned according to the prevailing wind direction. Then the hydraulic piston cylinder device 8*a* is actuated to lift the gang plank from the support 14 and thereafter the turntable 7 is hydraulically actuated to turn the gang plank into the position opposite the coupling rod 12 as shown in the drawing.

With the coupling jaws 11 swung open (as shown in the drawing) the gang plank 4 is (further) extended until the coupling rod 12 gets positioned between the coupling jaws 11, after which the coupling jaws 11 may close around the coupling rod 12. The hydraulic circuit may be arranged such that when the coupling jaws 11 are closing, the hydraulic drive means (not shown) for the turntable 7 will become relieved of pressure, so that mutual angular displacements of the gang plank and the vessel can and may take place in the horizontal plane.

Furthermore closing of the coupling jaws will cause the piston cylinder devices 8*b* and 8*c* to become relieved of pressure, as a result of which the gang plank section 4*b* may freely move in and out and the distance from the pole 1 to the up and down bobbing vessel can and may vary, while the gang plank may also freely hinge relative to the cross-over platform 9 as the latter is now held in position by the closed jaws 11. Moreover, in this way, an extension of the gang plank will automatically take place when in the next and final stage the hydraulic piston cylinder device 8*a* is put in operation to move the coupling device 10 with its closed jaws 11 along the coupling rod 12 upwardly and place the cross-over platform 9 and thereby the outer end of the gang plank 4 at the level of the pole platform 3. When reaching the latter position locking in this position is taking place, while at the same time the hydraulic cylinder device 8*a* is also relieved of pressure, so that from this point of time the piston rod of the cylinder device may freely move in and out to allow rolling movements of the ship 2 (in the position shown in the drawing) to take place.

The cross-over of personnel via the (possibly slightly swinging) gang plank 4 and the cross-over platform 9 onto the platform 3 can now take place easily and safely, whereas it is equally easy and safe for the personnel to board the ship again after having finished the job.

Figure 2A:
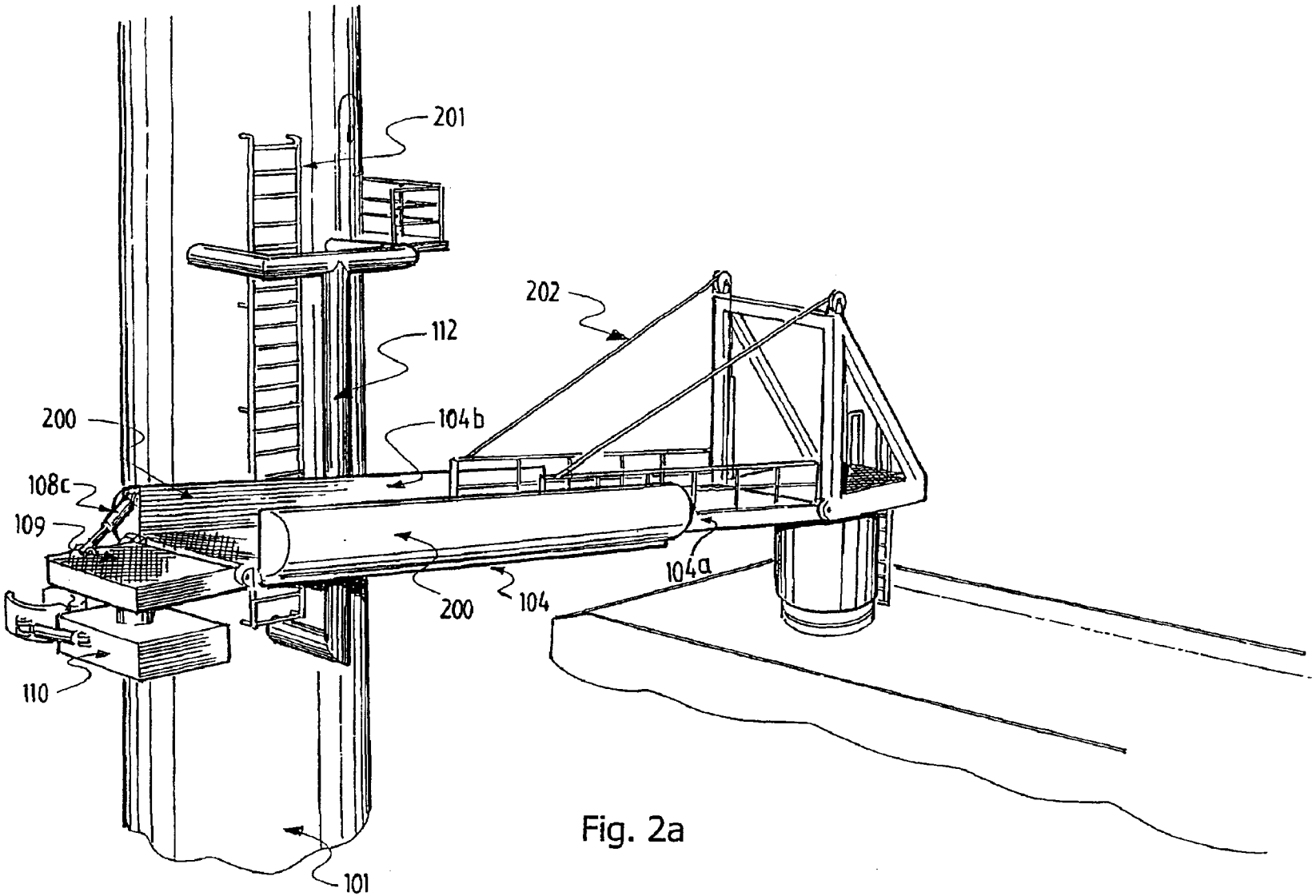
FIG. 2A is a perspective view of the vessel of the present invention in an alternative embodiment, wherein the gang plank is in its extended position and directed tangentially relative to an offshore monopole
Figure 2B:
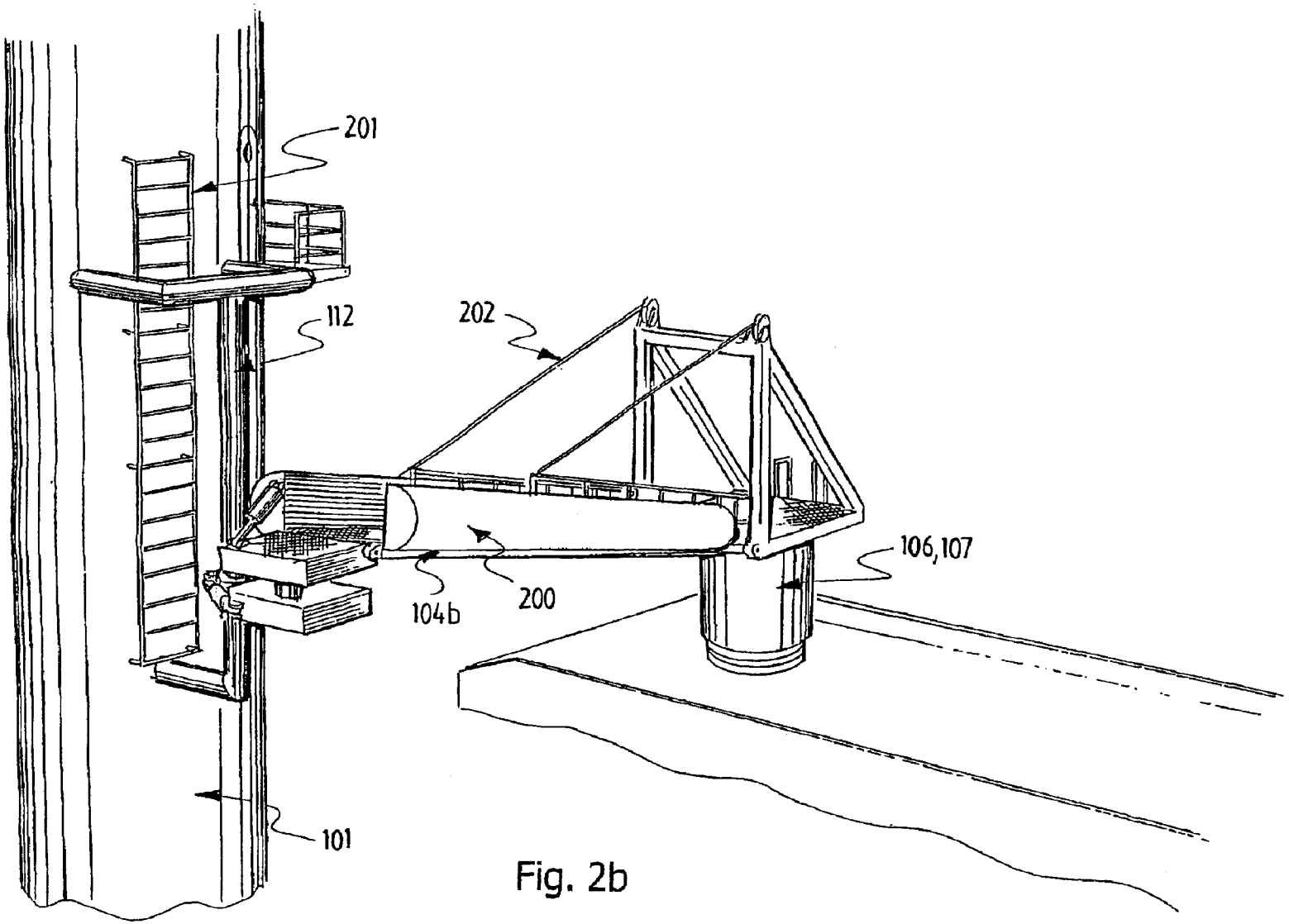
FIG. 2B shows the vessel of FIG. 2A in the same position relative to the monopole, but now with the (partially) retracted gang plank coupled to the monopole.

With reference to FIGS. 2A and 2B the vessel shown therein is very similar to the ship of FIG. 1. Corresponding parts have been designated by the same reference numbers as used in FIG. 1, but increased by the number 100.

The vessel 102 is more particularly adapted to be positioned with its extended gang plank 104 oriented substantially tangentially relative to the monopole 101 (see FIG. 2A), from which position the gang plank 104 can be readily retracted until the coupling between the vertically extending engagement/coupling rod 112 and the coupling device 110 is effected.

While carrying out the coupling procedure with the vessel in the embodiment of FIGS. 2A–2B the gang plank 104 will have its slidable section 104*b* engaging the engagement rod 112. To this end the slidable section 104*b* is constituting the outer section of the telescopic gang plank and provided with side buffers 200.

Furthermore, the embodiment of FIGS. 2A–2B relates to a monopole 101, whereby a ladder 201 is provided behind the engagement rod 112. Upon completion of the coupling to the engagement rod 112 one can thus step from the platform 109 onto the ladder 201 and thereby onto the pole body without the need to first displace the gang plank end along the engagement rod 112 upwardly. Accordingly the hydraulic cylinders 8*a* provided in the embodiment of FIG. 1 have been substituted in the embodiment of FIGS. 2A–2B by an adjustable suspension bracket 202. In a way similar to the embodiment of FIG. 1, the coupling device 110, the drive means (not shown in the drawing) for extending and retracting the gang plank and the actuating means for the turntable 207 may be connected such, that when the coupling jaws of the coupling device 110 have closed about the engagement rod 112, the gang plank will be free to extend and retract and also free to turn relative to the vessel 102.

What is claimed is:

1. A vessel provided with a telescopingly extendable gang plank which is connectable to an offshore pole body, said gang plank having one end movably mounted on the vessel about horizontal and vertical axes and carrying at its free end a coupling device which is adapted to cooperate with an engagement rod that projects from said pole body, wherein said coupling device is arranged to releasably enclose a vertically directed engagement rod and wherein drive means are provided to allow said gang plank to extend between said vessel and said pole body independently from movement of said vessel and further wherein said coupling device is suspended to said free end of said gang plank for movement about three mutually perpendicularly directed axes.

2. A vessel according to claim 1, wherein said coupling device is provided with coupling jaws adapted to move between closed and opened positions and to enclose the engagement rod.

3. A vessel provided with a telescopingly extendable gang plank which is connectable to an offshore pole body, said gang plank having one end movably mounted on said vessel about horizontal and vertical axes and carrying at its free end a coupling device which is adapted to cooperate with an engagement rod that projects from said pole body, wherein said coupling device is arranged to enclose a vertically directed engagement rod and wherein drive means are provided to allow said gang plank to extend between said vessel and said pole body independently from movement of said vessel, wherein said coupling device is suspended to said free end of said gang plank for movement about three mutually perpendicularly directed axes, and further wherein a retractable/extendable section of said gang plank has said free end pivotally connected, about a transverse axis that forms one of said three mutually perpendicularly directed axes, to a cross-over platform which carries said coupling device.

4. A vessel according to claim 3, wherein a longitudinally adjustable support rod is provided between said retractable/extendable section of the said plank and said cross-over platform.

5. A vessel according to claim 4, wherein coupling jaws adapted to move between closed and opened positions and to enclose the engagement rod, drive means for turning said gang plank about a vertical axis and for retracting/extending said gang plank, as well as said longitudinally adjustable support rod are connected to a common pressurized circuit, more particularly a hydraulic circuit.

6. A vessel according to claim 5, wherein said pressurized circuit is arranged such that in a closed position of said coupling jaws at least said drive means for turning and retracting/extending said gang plank, as well as said adjustable support rod are automatically relieved of pressure.

7. A vessel according to claim 6, wherein the engagement rod suspends from a work platform fastened to the pole body and wherein said hydraulic circuit is further arranged such that said drive means for luffing said gang plank are automatically relieved of pressure when or as soon as said closed coupling jaws are in an upper position on the engagement rod.

8. A vessel provided with a telescopingly extendable gang plank which is connectable to an offshore pole body, said gang plank having one end movably mounted on said vessel about horizontal and vertical axes and carrying at its free end a coupling device which is adapted to cooperate with an engagement rod that projects from said pole body, wherein said coupling device is arranged to enclose a vertically directed engagement rod and wherein drive means are provided to allow said gang plank to extend between said vessel and said pole body independently from movement of said vessel and further wherein said coupling device is suspended to said free end of said gang plank for movement about three mutually perpendicularly directed axes, wherein a retractable/extendable section of said gang plank extends along an outer side of a stationary section of the gang plank.

9. A vessel according to claim 8, wherein the retractable/extendable section of said gang plank is provided with side buffers.

10. An offshore pole body comprising an engagement rod for a telescoping extendable gang plank of a vessel, said gang plank having one end movably mounted on said vessel about horizontal and vertical axes and carrying at its free end a coupling device which is adapted to cooperate with said engagement rod, wherein said coupling device is arranged to enclose said engagement rod and wherein drive means are provided to allow said gang plank to extend between said vessel and said pole body independently from movement of said vessel, said engagement rod projects from said pole body, and said engagement rod is vertically directed wherein said coupling device is suspended to said free end of said gang plank for movement about three mutually perpendicular directed axes.

11. An offshore pole body according to claim 10, wherein a ladder is provided on said pole body, behind and substantially parallel to said engagement rod.

* * * * *